US008336634B2

(12) United States Patent
Eatwell et al.

(10) Patent No.: US 8,336,634 B2
(45) Date of Patent: Dec. 25, 2012

(54) SYSTEM AND METHOD FOR PACKING

(75) Inventors: William D. Eatwell, Pearland, TX (US); Jason A. McCann, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 330 days.

(21) Appl. No.: 12/414,157

(22) Filed: Mar. 30, 2009

(65) Prior Publication Data

US 2009/0242215 A1 Oct. 1, 2009

Related U.S. Application Data

(60) Provisional application No. 61/040,518, filed on Mar. 28, 2008.

(51) Int. Cl.
*E21B 33/12* (2006.01)

(52) U.S. Cl. ..... 166/387; 166/118; 166/196

(58) Field of Classification Search ..... 166/118, 166/127, 132, 141, 196, 195, 206, 387, 187; 277/336, 338, 387, 358
See application file for complete search history.

(56) References Cited

U.S. PATENT DOCUMENTS 4,253,676 A * 3/1981 Baker et al. ..... 277/334
4,842,753 A * 6/1989 Mori et al. ..... 508/206
4,941,350 A 7/1990 Schneider
5,024,273 A * 6/1991 Coone et al. ..... 166/289
5,398,755 A 3/1995 Eslinger et al.
5,613,555 A * 3/1997 Sorem et al. ..... 166/187
5,778,982 A * 7/1998 Hauck et al. ..... 166/387
6,296,054 B1 * 10/2001 Kunz et al. ..... 166/187
6,732,800 B2 5/2004 Acock et al.
6,843,315 B2 * 1/2005 Coronado et al. ..... 166/196
7,591,321 B2 9/2009 Whitsitt et al.
2007/0151724 A1 7/2007 Ohmer et al.
2009/0242215 A1 10/2009 Eatwell et al.

* cited by examiner

*Primary Examiner* — David Andrews
*Assistant Examiner* — Michael Wills, III
(74) *Attorney, Agent, or Firm* — Chad Sullivan; Rodney Warfford; Tim Curington

(57) ABSTRACT

Disclosed herein are sealing assemblies which include a mandrel; an inner element formed around the mandrel; an outer element formed around the inner element; and a plurality of slats arranged between the inner and outer elements. The slats have a friction-reducing agent on the surface of the slats. Also disclosed herein are methods for zonal isolation within a wellbore. The methods include providing a mandrel; providing an inner element formed around the mandrel; providing an outer element formed around the inner element; providing a plurality of slats arranged between the inner and outer elements; and axially compressing the inner element and the outer element to radially expand the inner element and outer element. The slats have a friction-reducing agent on their surface.

20 Claims, 4 Drawing Sheets

SYSTEM AND METHOD FOR PACKING

RELATED APPLICATIONS

This application claims priority to U.S. Provisional Patent Application Ser. No. 61/040,518 filed Mar. 28, 2008, incorporated herein by reference.

BACKGROUND

In typical wellbore operations, mechanical set packers or plugs, used in tubing and open hole applications, require large radial expansion annular sealing capabilities. This radial expansion requirement can result in excessive element extrusion under high differential pressure loads, thereby causing back up ring failure, sealing gaps, and element failure. Current open hole completion technology utilizes external casing packers (ECP), which requires a complicated inflation method during the completion process. Over time, ECPs can leak or lose annular sealing ability. The mechanical set packer, as a non-inflation tool, simplifies the installation operation, and provides a more positive seal for long term applications.

U.S. Pat. No. 6,843,315 and associated reference patents refer to packers or plugs which undergo large expansions to set, such as through tubing, followed by setting in casing or open hole. Currently, compression set packers have a known problem of internal friction drag occurring during an elements axial compressive travel. It would be advantageous to design a compression set packer which reduced or eliminated problems caused by internal friction drag.

SUMMARY

Disclosed herein is a sealing assembly comprising a mandrel; an inner element formed around the mandrel; an outer element formed around the inner element; and a plurality of slats arranged between the inner and outer elements. The slats have a friction-reducing agent on the surface of the slats.

Also disclosed herein is a method for zonal isolation within a wellbore comprising providing a mandrel; providing an inner element formed around the mandrel; providing an outer element formed around the inner element; providing a plurality of slats arranged between the inner and outer elements; and axially compressing the inner element and the outer element to radially expand the inner element and outer element. The slats have a friction-reducing agent on their surface.

DETAILED DESCRIPTION

Figure 1:
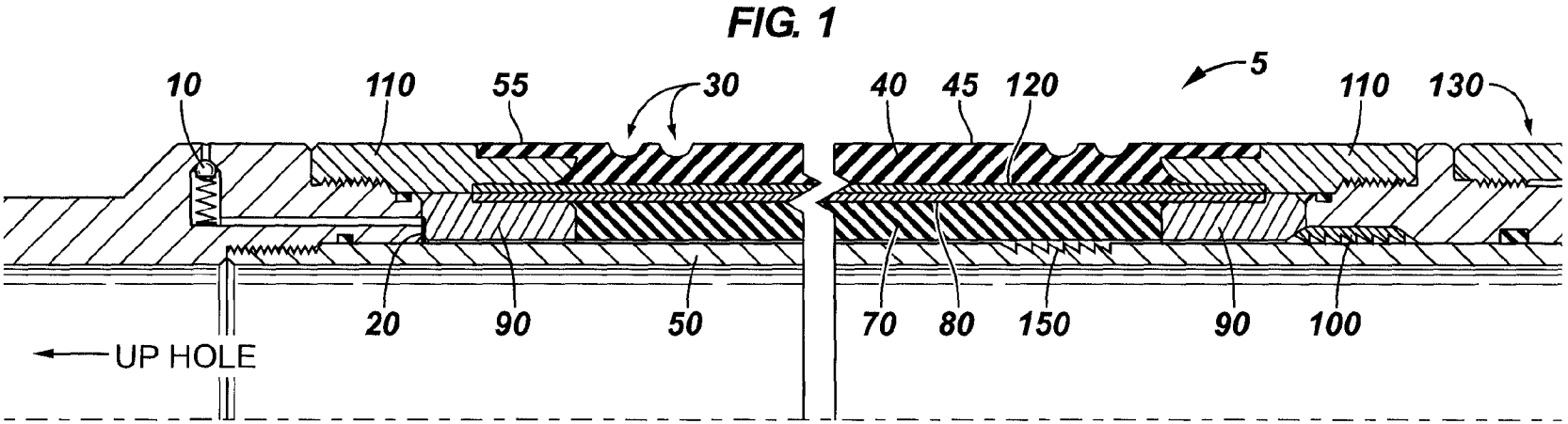
FIG. 1 is a schematic drawing of a packer in accordance with embodiments of the present invention.

In the following description, numerous details are set forth to provide an understanding of the present invention. However, it will be understood by those skilled in the art that the present invention may be practiced without these details and that numerous variations or modifications from the described embodiments may be possible.

Embodiments as disclosed herein include a compression set, bi-directional sealing, large expansion packing element, designed to set in an open hole or casing application. This mechanical set packer may be set in an open hole application but can also be set in well bore casing. The embodiments disclosed herein utilize a unique, multiple overlapping slat assembly which, when mechanically compressed during setting action, expands radially providing internal support to the inner and outer packing element seals. It preferably also provides back-up ring support for each end of the inner element seal when fully compressed. This new multiple slat assembly, along with the inner mandrel, can be coated with a slippery substance, such as Teflon (a poly(tetrafluoroethylene)), to prevent compression travel restraint. Additionally, the coated slat assembly(ies) can be encircled with several banded expansion restraint devices, pre-positioned along the axis of the slat assembly, to ensure that initial setting forces on the elements are effectively transferred to the opposite and fixed setting force end. Also, these restraint devices, and coated parts, may prevent premature element expansion and bunching which could weaken the long elements sealing grip at full set in a bore hole or casing. The multiple slat support assembly as disclosed herein, when selectively coated with Teflon (or another acceptable friction reducing agent), and positioned between the inner and outer rubber seals, helps reduce internal friction drag occurring during an elements axial compressive travel, and also allows both elements to move independently during setting. This coating, along with optional expansion restraint bands, allows the rubber elements to compress on their axis and expand radially from the opposite end of the setting force. This helps improve the contact sealing length of the packer element, and its bi-directional sealing function in a wellbore or casing.

Embodiments disclosed herein further include a dual internal expandable support assembly consisting of multiple overlapping metal slats coated with a slippery substance. Embodiments may also include multiple expandable bands pre-positioned over the slat assembly to control setting forces. The slat assemblies are assembled and positioned between inner and outer rubber elements, which results in an outward flex of the total assembly during compressive setting, and provides better sealing contact geometry in the wellbore. A lesser strength and lower operating temperature slat assembly could use composites for the slat material. The packer assembly support mandrel, positioned under the inner rubber seal, can also be coated selectively with Teflon or other acceptable friction reducing agent, to further improve the setting and compressing force transfer process.

Referring to FIG. 1, there is shown a packing element 5 which comprises a check valve 10, a thrust bearing 20, an outer element 40 having grooves 30 and a sealing surface 45, an inner element 70, a mandrel 50, outer slats 120, inner slats 80, setting piston 130, inner slat holding member 90, outer slat holding member 110, and ratcheting elements 100 and 150. In the assembly, inner element 70 surrounds mandrel 50. Inner element 70 may be made from any material that is acceptable in the manufacture of compression set packers, such as a high temperature nitrile.

Figure 3:
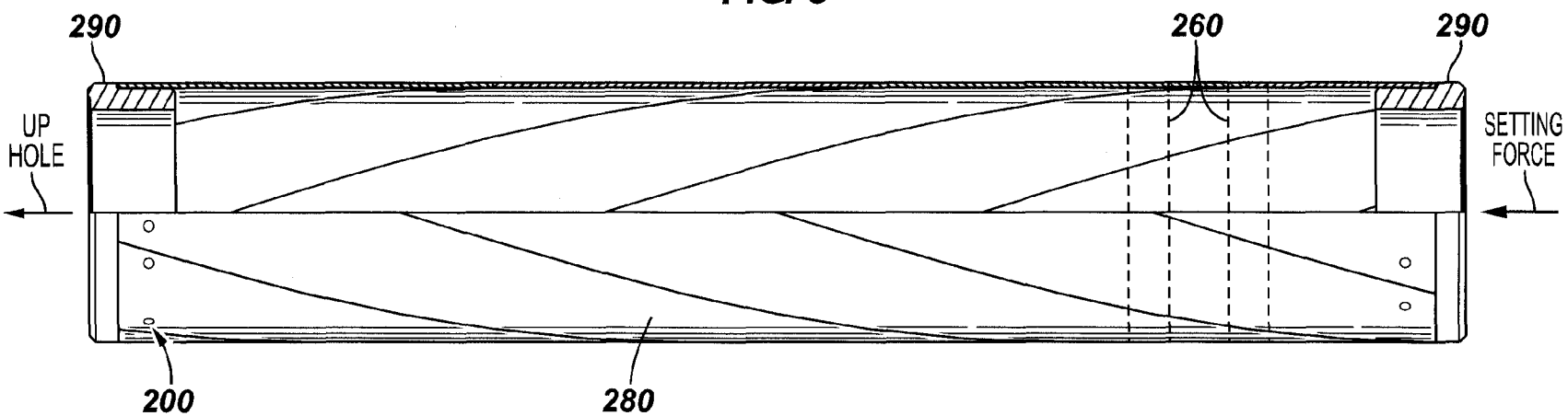
FIG. 3 is a schematic drawing of components of a packer in accordance with embodiments of the present invention.

Surrounding inner element 70 are inner slats 80 which are preferably arranged in a helical pattern (as is shown in FIG. 3 where the inner slats are indicated at 280). Outside of the inner slats 80 are the outer slats 120 which are also preferably arranged in a helical pattern. In addition to helical pattern, the slats 80 and 120 may be arranged in any pattern or other configuration which would allow them to slide across each other while the packer is expanding. Outer slats 120 are attached to outer slat holding member 110 by spot welding or any other method as is known to one of ordinary skill in the art Inner slats 80 are likewise attached to inner slat holding member 90 by spot welding or any other method as is known to one of ordinary skill in the art. It is preferred that a friction reducing agent be placed in at least one of: (1) the space between inner slats 80 and inner element 70; (2) the space between inner slats 80 and outer slats 120; and (3) the space between outer slats 120 and outer element 40. The friction reducing agent may be a coating such as Teflon or it may be a substance such as a grease or friction reducing powder (e.g., MolyKote by Dow Corning (www.dowcorning.com) or graphite). Further explained, packing element 5 contains a dual internal expandable radial support assembly made from multiple overlapping metal slats 80 and 120 in a helical pattern. It is made in two assemblies. An upper slat assembly 120 with slats mounted in a clockwise rotation, and an inner slat assembly 80 with slats mounted in a counter clockwise rotation. Alternatively, an upper slat assembly 120 and an inner slat assembly 80 could both be mounted clockwise or counterclockwise. Slat rotations, end to end, can be full or partial. The inner packer element 70 is located and restrained under the inner slat assembly, and the outer packer element 40 is mounted on the upper slat assembly and restrained. The upper element outer surface 45 can be configured to flex and expand variably to better seal in the well bore.

Radially outside of outer slats 120 is outer element 40. Outer element 40 may be made from any material that is acceptable in the manufacture of compression set packers, such as a high temperature nitrile. Outer element 40 may, but does not necessarily, comprise grooves 30 on its surface to assist in flexing during expansion. Additionally, outer element 40 preferably comprises an overlap portion 55 which may be bonded by any acceptable method as would be known to one of ordinary skill in the art to slat holding member 110. The bonding is preferably performed by an adhesive. In some preferred embodiments, a basic two-part rubber-to-metal high strength industrial epoxy or glue system is used. It is preferred that the adhesive system be acceptable for use in high temperature and corrosive environments. In some embodiments, primer is applied to the metal, the rubber laid over the primed metal, and the assembly is cured in an oven where the rubber "cures" onto the metal. Specific examples of acceptable adhesive systems are ChemLok 205 primer and ChemLok BN adhesive available from LORD Corporation of North Carolina (www.lord.com).

To set packer, setting piston 130 moves in a direction which compresses the elements 40 and 70. The pressure for the compression may be delivered hydraulically, by the use of hydrostatic pressure within the wellbore, or by any other acceptable means such as is disclosed in U.S. Pat. No. 7,040,402, incorporated herein by reference. During axial compression of the elements 40 and 70, the elements extend radially, e.g., towards the casing or borehole wall. As the elements 40 and 70 expand radially, slats 80 and 120 slide across one another to reduce internal stresses within the element assembly (comprising the two elements 40 and 70 and two sets of slats 80 and 120). Also, as the elements are compressed, ratcheting elements 100 and 150 engage to prevent decompression of elements 40 and 70.

In practice, check valve 10 operates to prevent creation of a vacuum under the element 70. Annulus or wellbore fluid is allowed in so that the elements 40 and 70 are not sucked down onto the mandrel. Additionally, because check valve 10 prevents flow in the other direction, it forms a bladder that helps the compressive forces expand the elements 40 and 70 outward.

Figure 2:
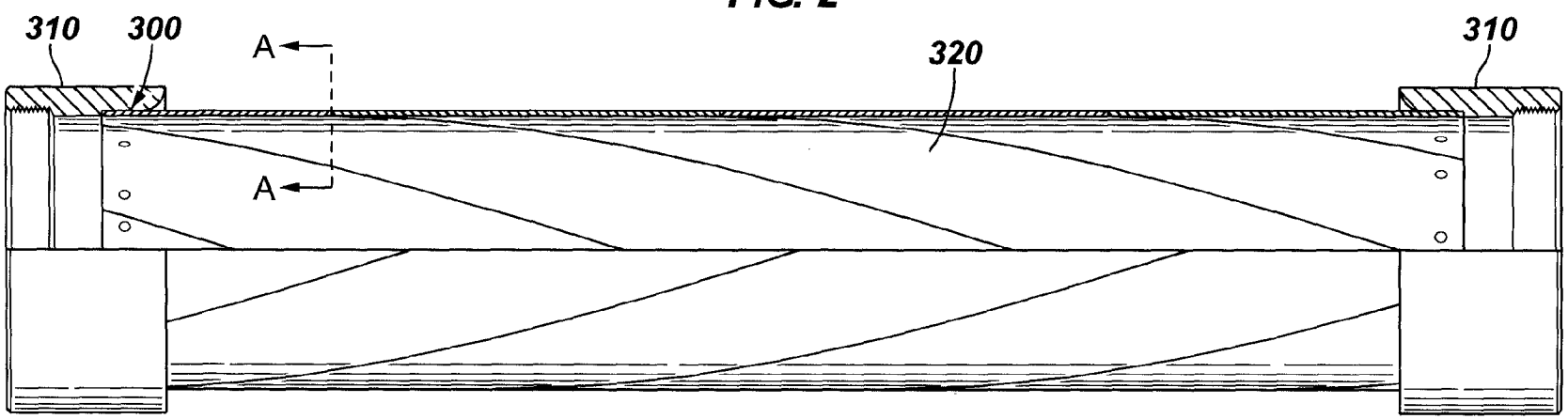
FIG. 2 is a schematic drawing of components of a packer in accordance with embodiments of the present invention.

Referring now to FIG. 2, there is shown an expanded schematic view of outer slats 320 which may be used in embodiments of the present invention. The slats may be spot welded at 300 to slat holding member 310. Preferably, slats 320 are made from a non-corrosive alloy.

Figure 2A:
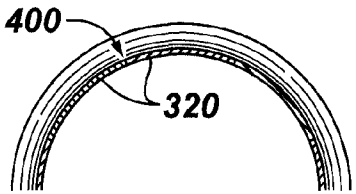

Referring now to FIG. 2A, there is shown a cross-sectional view of slats 320 which shows outer slats 320 butted together in a full circle at interface 400. In FIG. 2A, there is shown a fabrication step designed to improve the strength of the welded slat assembly, on both ends, and form a "back-up" ring during the compressive and radial forces acting on the element assembly. This step helps prevent the inner rubber element from extruding out both ends of the welded assembly at the center of the element. As is shown in FIGS. 2 and 2A the slats overlap to prevent extrusion butt together at the end 400.

Referring now to FIG. 3, there is shown an expanded schematic view of inner slats 280 which are attached to end ring 290 on both ends by spot welds 200. End rings 290 are metal end rings to retain the welded slats. In an optional configuration, retaining elements or restraint bands 260 may be installed around inner slats 280 to restrain expansion of the inner slats 280 and the packer element as a whole on the side of the packer for which it is desired to retard the expansion. It may be desirable to control which portion of the packer expands first, for example to ensure proper radial expansion and to prevent the packer from sliding within the wellbore or casing or other surface to which it expands and contacts. This use of expandable restraint bands pre-positioned and fixed on the inner (or outer) slat system assembly, will assist in directing the applied setting force toward the opposite and fixed end of the packer element assembly. The restraint bands 260 may be made of any acceptable material, including Kevlar (available from DuPont (www2.dupont.com/Kevlar/en_US/index.html or www.dupont.com)) or any other material with a predictable breaking point.

Further with respect to FIGS. 2 and 3, the slat material 320 and 280 can be metal and welded, e.g., at 300 and 200 respectively or mechanically attached between end rings 310 and 290 respectively that are secured to the packer mandrel. The use of inner and outer slat assemblies, which are allowed to flex independently during setting compressive forces acting on the inner and outer rubber elements, are expected to improve sealing in open hole geometry. The multiple slat system may also act as a backup ring, on both ends, preventing the inner rubber element seal from extruding out the ends under high differential pressure loads. Both of the both slat assemblies in FIGS. 2 and 3 are designed to lock together within the tool, or the inner slat assembly can be designed to rotate freely during setting action.

Figure 4A:
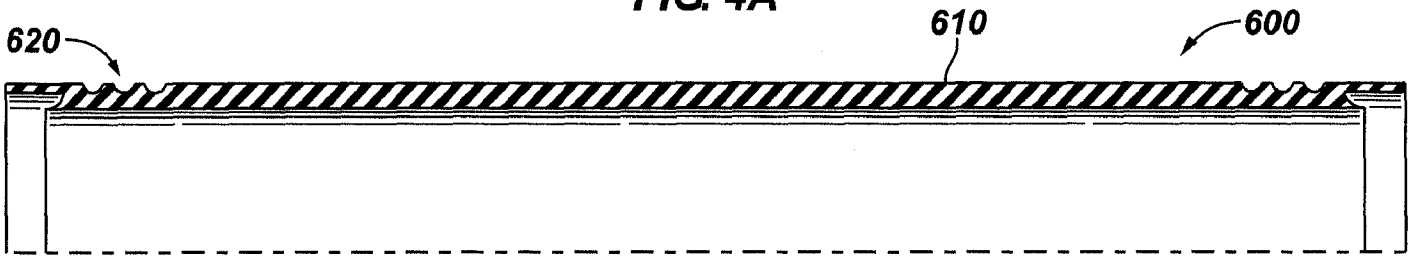
FIGS. 4A, 4B, and 4C are schematic drawings of components of a packer in accordance with embodiments of the present invention.
Figure 4B:
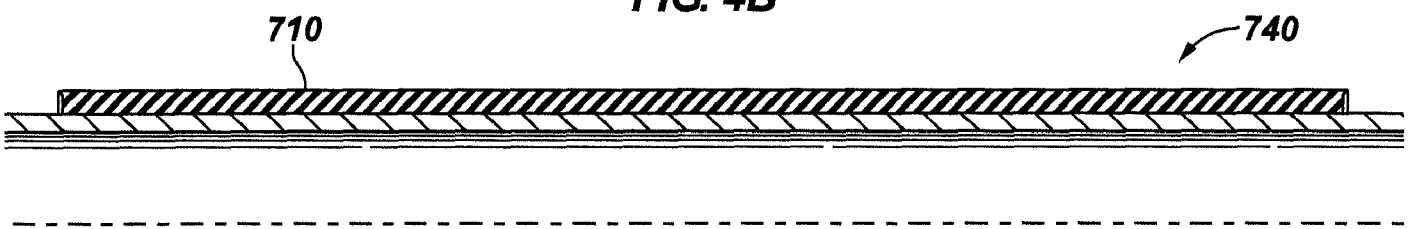
Figure 4C:
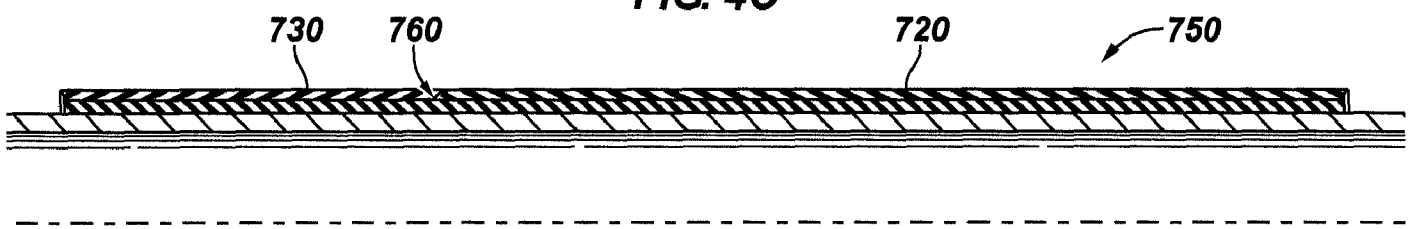

With respect to FIGS. 4A, 4B, and 4C the outer sealing element 600 and inner sealing element 740 and alternatively 750 may be made of a composite or rubber material 710, in a cylinder configuration, that is molded, or machined. Outer element 600 surface configurations can be configured or shaped to improve overall element expansion toward final setting in the wellbore. For example, grooves 620 may be made in the outer element 610. The inner element 710 can be a solid or a stacked combination and mate at various angles 760 in order to assist in mechanical compression and radial expansion. The use of selectively coating or lubricating the two slat assemblies, and the corresponding inner mandrel, with a slippery substance, such as a poly(tetrafluoroethylene) such as Teflon or any other acceptable friction reducing agent, will improve the axial movement of the compressing inner and outer rubber elements toward the pre-determined expanding mode.

Figure 5:
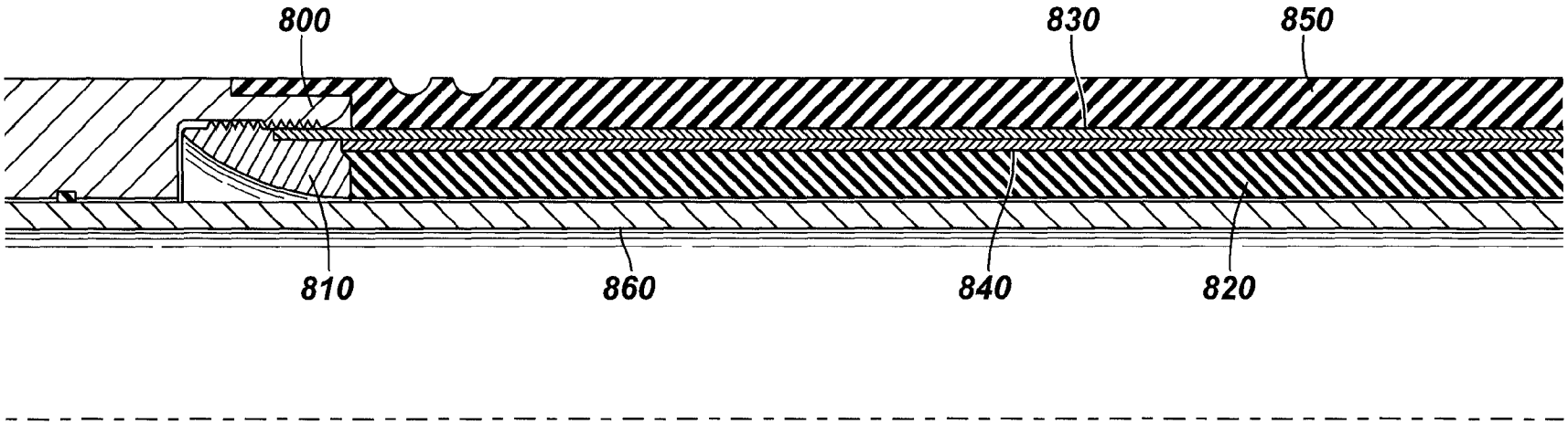
FIG. 5 is a schematic drawing of components of a packer in accordance with embodiments of the present invention.

FIG. 5 further describes a compression set, bi-directional sealing, large expansion packing element which contains a single internal expandable radial support assembly made from multiple overlapping metal slats bonded to "conical" ended rings in a straight, along the axis, fabrication.

Referring to FIG. 5, there is shown alternate configurations comprising loose connection 800, inner element 820, inner slats 840, outer slats 830, outer element 850, mandrel 860, and conical end coupling 810. Outer and inner elements 850 and 820 and outer and inner slats 830 and 840 may be designed as discussed above. In the alternative embodiment shown in FIG. 5 the loose connection 800 may be loose to allow the slat assembly to arch towards an eccentric wellbore and end coupling 810 may be conically shaped, i.e., have a sloped shoulder to provide an arching action in eccentric wellbores. These elements 800 and 810 working together assist in the sealing of the packer within an eccentric wellbore. The use of a loose and trapped conical ended ring allows the slats in the multiple slat assembly to rotate and flex independently during setting/compressive forces acting on the inner and outer rubber elements. This should improve outer rubber sealing in an open hole geometry by allowing the slats to adjust to the geometry of the open hole. The multiple slat system also functions as a backup ring, on both ends, preventing the inner rubber element seal from extruding out the ends under high differential pressure loads.

The slat material can be metal or composite, welded, or bonded or mechanically attached between special conical ended rings that are secured to the packer mandrel.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

The invention claimed is:

1. A sealing assembly comprising:
- a mandrel;
- an inner element formed around the mandrel;
- an outer element formed around the inner element;
- a support assembly arranged between the inner and outer elements;
- a plurality of slats of the support assembly;
- a friction reducing agent of the support assembly disposed on the plurality of slats of the support assembly to reduce friction between the support assembly and at least one of the inner element and outer element; and
- a restraint hand arranged between the inner and outer elements and around a first end of at least one of the plurality of slats to restrain radial expansion of the inner element and the slats proximate the first end and to allow radial expansion of the inner element and the slats distal the first end.

2. The sealing assembly of claim 1 wherein the friction reducing agent is a poly(tetrafluoroethylene).

3. The sealing assembly of claim 1 wherein the friction reducing agent is grease.

4. The sealing element of claim 1 further comprising a conical end coupling.

5. The sealing element of claim 1 wherein the slats are arranged in a helical pattern.

6. The sealing element of claim 1 wherein the outer element comprises a nitrile rubber.

7. The sealing element of claim 1 wherein the friction reducing agent is a powder.

8. The sealing element of claim 1 wherein the plurality of slats of the support assembly includes one or more outer slats formed around one or more inner slats.

9. A method for zonal isolation within a wellbore comprising:
- providing a mandrel;
- providing an inner element formed around the mandrel;
- providing an outer element formed around the inner element;
- providing a plurality of slats having a friction-reducing agent on a surface of the slats, the plurality of slats having the friction reducing agent on the surface thereof arranged between the inner and outer elements;
- axially compressing the inner element and the outer element to radially expand the inner element and the outer element; and
- restraining radial expansion of the inner element and the slats proximate a first end of the plurality of slats with a restraint band and allowing radial expansion of the inner element and the slats distal the first end.

10. The method of claim 9 further comprising providing a ratcheting mechanism for preventing decompression of the axially compressed inner element and outer element.

11. The method of claim 9 wherein axially compressing step occurs in an eccentric portion of the wellbore.

12. The method of claim 9 wherein the outer element comprises a nitrile rubber.

13. The method of claim 9 where in the friction reducing agent is a poly(tetrafluoroethylene).

14. The method of claim 9 where in the friction reducing agent is a grease.

15. The method of claim 9 where in the friction reducing agent is a powder.

16. A sealing assembly comprising:
- a mandrel;
- an inner element formed around the mandrel;
- an outer element formed around the inner element;
- a plurality of inner slats arranged between the inner and outer elements;
- a plurality of outer slats formed around one or more inner slats;
- a friction reducing agent coated on the slats to reduce friction between the plurality of inner slats and the plurality of outer slats; and
- a restraint band arranged between the inner and outer elements and around a first end of at least one of the plurality of slats to restrain radial expansion of the inner element and the slats proximate the first end and to allow radial expansion of the inner element and the slats distal the first end.

17. The sealing element of claim 16 wherein the friction reducing agent is disposed between the one or more inner slats and the inner element.

18. The sealing element of claim 16 wherein the friction reducing agent is disposed between the one or more inner slats and the one or more outer slats.

19. The sealing element of claim 16 wherein the friction reducing agent is disposed between the one or more outer slats and the outer element.

20. The sealing element of claim 16 wherein the slats are arranged in a helical pattern.

* * * * *